US005079392A

United States Patent [19]

Tsukushi et al.

[11] Patent Number: 5,079,392

[45] Date of Patent: Jan. 7, 1992

[54] GAS CIRCUIT BREAKER

[75] Inventors: Masanori Tsukushi; Osamu Koyanagi; Yashuharu Seki; Yukio Kurosawa, all of Hitachi, Japan

[73] Assignee: Hitachi, Ltd., Tokyo, Japan

[21] Appl. No.: 543,440

[22] Filed: Jun. 26, 1990

[30] Foreign Application Priority Data

Jun. 30, 1989 [JP] Japan ..... 1-166997

[51] Int. Cl.[5] ..... H01H 33/88

[52] U.S. Cl. ..... 200/148 A; 200/148 R; 200/148 B

[58] Field of Search ..... 200/148 A, 148 B, 148 R

[56] References Cited

U.S. PATENT DOCUMENTS 3,839,613 10/1974 Tsubaki et al. ..... 200/148 A 4,440,997 4/1984 Garzon ..... 200/148 A

*Primary Examiner*—Harold Broome

*Attorney, Agent, or Firm*—Antonelli, Terry Stout & Kraus

[57] ABSTRACT

A gas circuit breaker comprising a pair of contactors contact portions of which are separable relatively from each other, an insulating nozzle of an electrically insulating material surrounding the contact portions of said contactors so as to guide a flow of gas, and a puffer chamber for compressing the gas in conjunction with a separating operation of the contact portions so as to supply it under guidance of the insulating nozzle, the gas from the puffer chamber being exhausted through exhaust passages passing through a hollow portion of the one contactor located within the insulating nozzle, wherein the exhaust passages are formed between the puffer chamber and the one contactor, and the gas circuit breaker further comprises block means serving to close during an initial stage of the separating operation and open afterward exhaust ports formed at ends of the exhaust passages located on the downstream side of the gas flow. This makes it possible to reduce the flow resistance to the gas flow used for arc extinguishment in cooperation with an arc-extinguishing gas flow passing through a throat portion of the insulating nozzle as well as to reduce a force required for operation.

10 Claims, 7 Drawing Sheets

GAS CIRCUIT BREAKER

BACKGROUND OF THE INVENTION

The present invention relates to a gas circuit breaker which opens a high-current electric circuit with use of gas, and more particularly, to a puffer type gas circuit breaker.

Conventionally known puffer type gas circuit breakers are disclosed in U.S. Pat. No. 3,839,613, "Development of 240/300 kV 50 kV 2,000A, 4,000 A, 8,000 A, 2-cycle Puffer Type SFhd 6 gas Circuit Breakers", Hitachi Review 23 (1974), pages 343 to 352 and "Development of High Power 2 Cycle Puffer Type Gas Circuit Breakers" IEEE Conf. Paper C 74 089-9, for example. A gas circuit breaker of such known type is shown in FIGS. 12 and 13.

This gas circuit breaker 101 is disposed in a container (not shown) in which an arc-extinguishing gas, such as $SF_6$ gas which is not shown, is filled. The gas circuit breaker 101 comprises a fixed member 104 which is allowed to stand stationary with respect to the container, which has a fixed arc contactor 109 and a main fixed contactor 110, a movable member 121 which has a main movable contactor 138 and a movable arc contactor 133 which is separable from the fixed arc contactor 109 in the axial direction of an arrow A so as to generate an arc 161 therebetween. A puffer chamber 130 is defined between a puffer cylinder 131 of the movable member 121 and a puffer piston 115 of a frame body 111 which is allowed to stand stationary with respect to the container. When the movable member 121 is made to move in the direction of the arrow A through an operating shaft member 124 of the movable member 121, due to a relative motion of the puffer piston 115 of the frame body 111 into the puffer chamber 130 in the direction of an arrow B, gas in the puffer chamber 130 is compressed and enters a chamber 190 defined in a nozzle 142 made of an electrically insulating material through an opening 132 formed at one end of the puffer chamber 130. When the movable member 121 is further drawn out in the direction of the arrow A with respect to the fixed member 104 until the tip end of the fixed arc contactor 109 slips out of a throat portion 147 of small diameter of the insulating nozzle 142 surrounding the tip ends of the contactors 109 and 133, the compressed gas in the chamber 190 flows through a region where the arc 161 is produced as a gas flow 162 passing through the throat portion 147 so as to cool the gaseous plasma of the arc 161. In this case, openings 139 of an exhaust passage 140 defined inside a shaft 191 of the movable member 121 are communicated with openings 120 formed in a cylindrical shaft portion 192 of the puffer piston 115, so that a gas flow 163 is formed simultaneously which is directed to flow from the chamber 190 and pass through the axial exhaust passage 140 and the openings 139 and 120. This gas flow 163 as well serves to cool the gaseous plasma of the arc 161. In consequence, double gas flows 162 and 163 effect cooling of the arc 161 to extinguish the arc 161, thereby interrupting the current between the fixed arc contactor 109 and the movable arc contactor 133.

However, in this kind of conventional gas circuit breaker 101, a large force is required for operation of separating the movable contactor 133 in the direction of the arrow A because of the following reasons; Since it is indispensable to compress the gas for generating an arc-extinguishing gas flow, this operating force could not be reduced so much. Further, the diameter of the exhaust passage 140 can not be made very large to avoid an increase in the diameter of the breaker although the exhaust passage 140 through the shaft 191 is long. In consequence, the flow resistance through the exhaust passage 140 is increased to hinder the gas from flowing sufficiently, resulting in that it may become hard to extinguish the arc 161.

In addition, there has also been known, as disclosed in Japanese Patent Unexamined Publication No. 53-117758A, for example, a gas circuit breaker of what is called thermal puffer type which comprises an expansion or arc-extinguishing chamber for compressing gas using heat of arc and which serves to extinguish an arc by blowing or puffing the gas compressed in the expansion chamber against the arc (i.e. by flowing the gas along the arc to cool the arc). However, in this thermal puffer type gas circuit breaker as well, although the double flow method is adopted by providing in the exhaust passage a pressure-responsive valve utilizing spring force with the intention of interrupting a large electric current as well, it is hard to extinguish the arc stably for a long time over a wide range of electric current due to presence of the pressure-responsive valve or the like, and the performance thereof in interrupting a small electric current may be lowered due to the pressure-responsive valve.

SUMMARY OF THE INVENTION

In view of the aforesaid points, an object of the present invention is to provide a gas circuit breaker having an improved large current breaking performance which is capable of reducing the flow resistance to a gas flow used for arc extinguishment in cooperation with an arc-extinguishing gas flow passing through a throat portion of an electrically insulating nozzle as well as of reducing a force required for operation.

According to the present invention, this object can be achieved by a gas circuit breaker which comprises a pair of contactors contact portions of which are separable relatively from each other, an insulating nozzle of an electrically insulating material surrounding the contact portions of the contactors so as to guide a flow of gas, and a puffer chamber means for compressing the gas therein in conjunction with a separating operation of the contact portion so as to supply it under guidance of the insulating nozzle, the gas from the puffer chamber means being exhausted through exhaust passage(s) passing through a hollow portion of the one of the contactors located within the insulating nozzle, wherein the exhaust passage(s) are formed between the puffer chamber and the one of the contactors, and the gas circuit breaker further comprises block means serving to close during an initial stage of the separating operation and open afterward exhaust ports formed at ends of the exhaust passage(s) located on downstream side of the gas flow.

In the gas circuit breaker according to the present invention, the puffer chamber means serving to compress the gas to be formed as an arc-extinguishing flow in conjunction with the separating or opening operation is formed to extend in the axial direction of a driving shaft connected with a movable element, and the exhaust passages through which the gas acted on an arc is exhausted are formed between the puffer chamber means and the movable element, and therefore, a length of the gas flow path in the exhaust passages can be significantly reduced as compared with the conventional puffer type gas circuit breaker, thereby making it possible to reduce the flow resistance in the exhaust passages.

Further, in the gas circuit breaker according to the present invention, since the block means serves to close the exhaust ports of the exhaust passages formed on the downstream said of the gas flow at least during the initial stage of a current breaking operation, it is possible not only to suppress the formation of an unnecessary gas flow passing through the exhaust ports in the initial stage of the current breaking operation but also to generate at a stroke a gas flow passing through a throat portion of the insulating nozzle and the gas flow passing through the exhaust passage because the block means permits the exhaust ports to be opened afterward. It is therefore possible to further improve the large current breaking performance due to gas flows in two directions or double gas flows.

BRIEF DESCRIPTION OF DRAWINGS

The object, features as well as advantages of the invention will be made clearer by following description of preferred embodiments of the invention referring to attached drawings in which.

DESCRIPTION OF PREFERRED EMBODIMENTS

Description will be given below of a first preferred embodiment of the present invention with reference to FIGS. 1 to 3.

Figure 1:
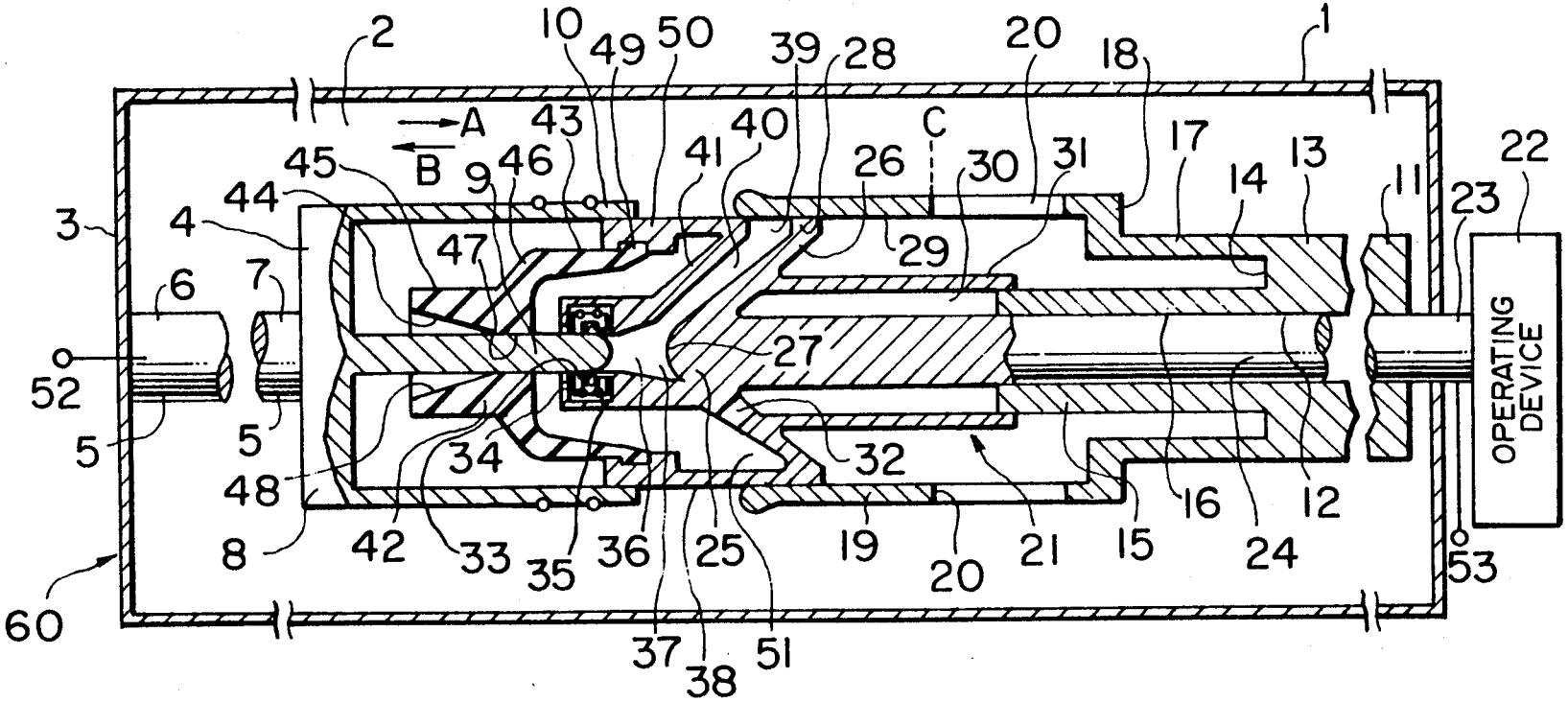
FIG. 1 is a sectional view of a gas circuit breaker according to a preferred embodiment of the present invention, showing a closed state.
Figure 2:
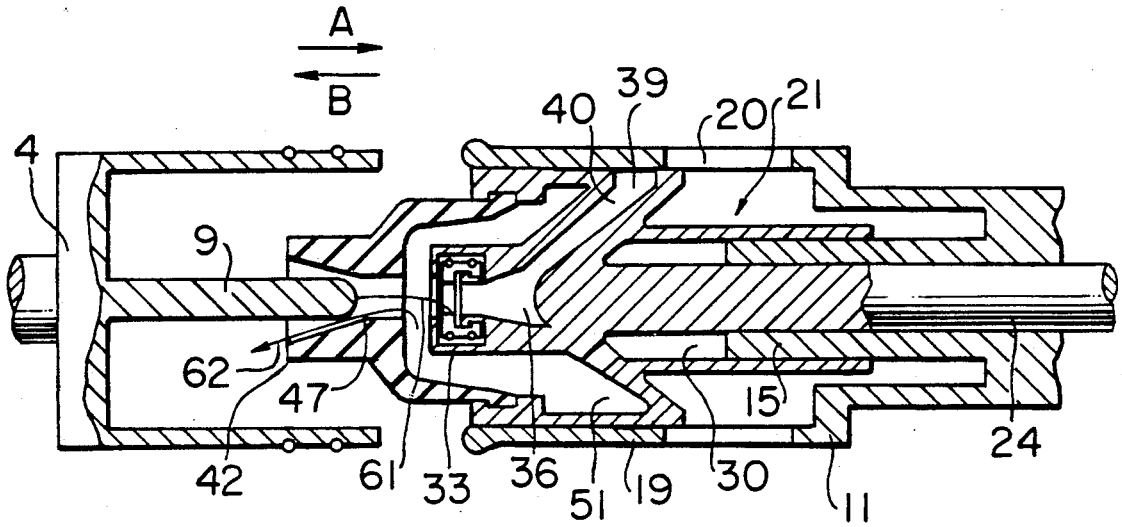
FIGS. 2 and 3 are sectional views of the gas circuit breaker of FIG. 1, but showing the initial stage and the intermediate stage of a breaking operation, respectively.
Figure 3:
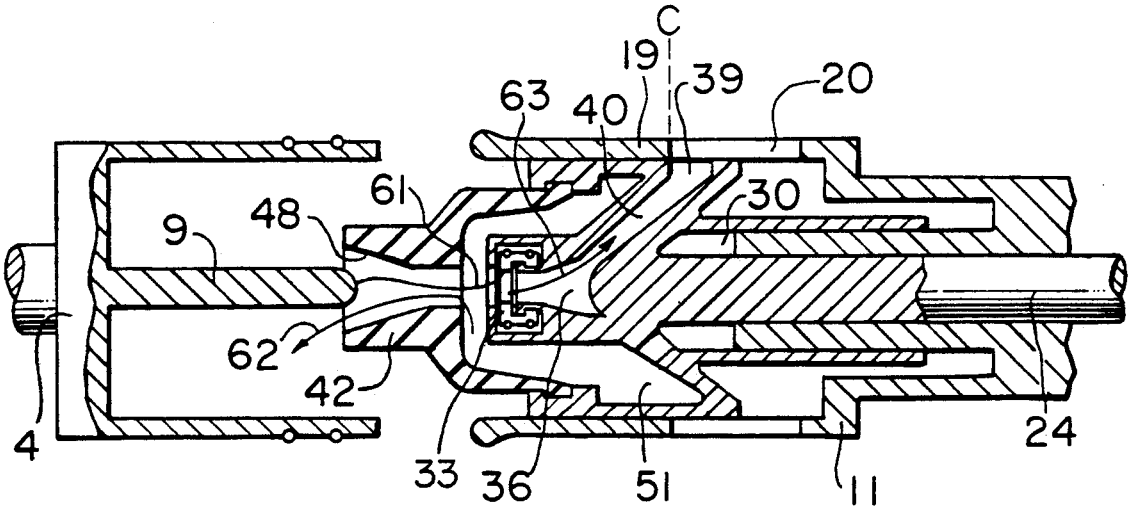
Figure 4:
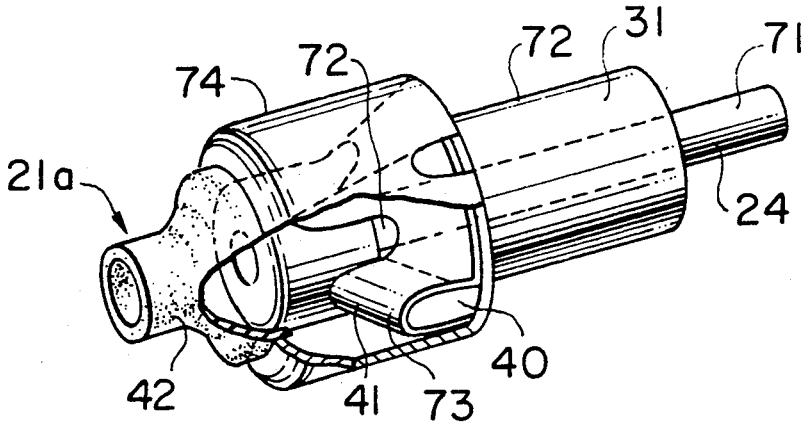
FIG. 4 is a partially broken perspective view of the gas circuit breaker of FIG. 1, showing an example of the concrete structure of a movable part.
Figure 5:
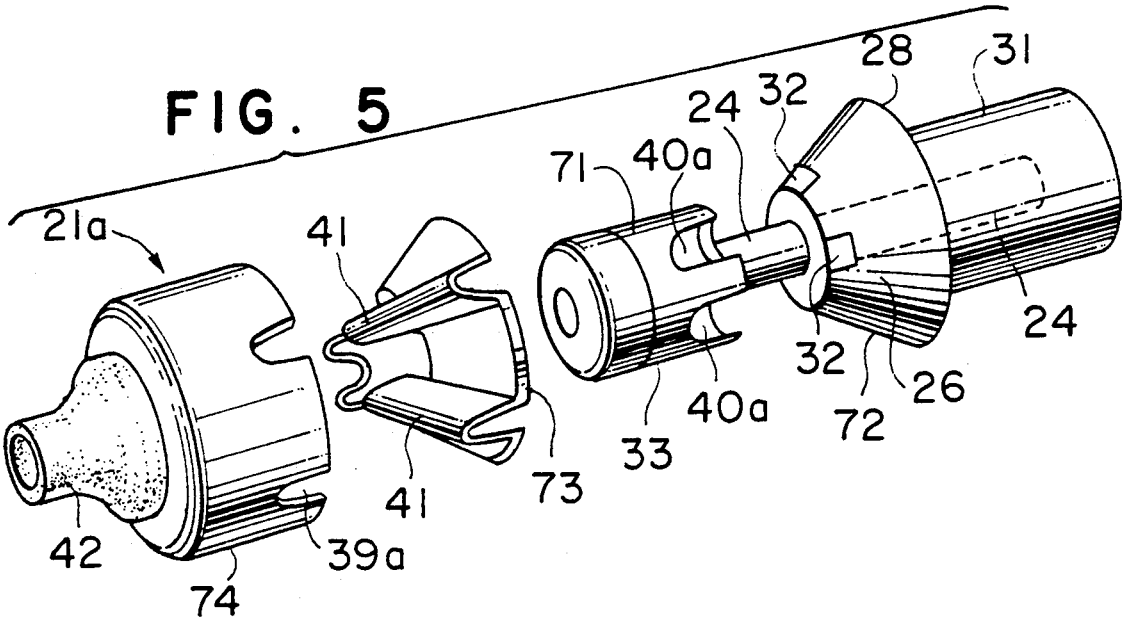
FIG. 5 is an exploded perspective view of FIG. 4.
Figure 6:
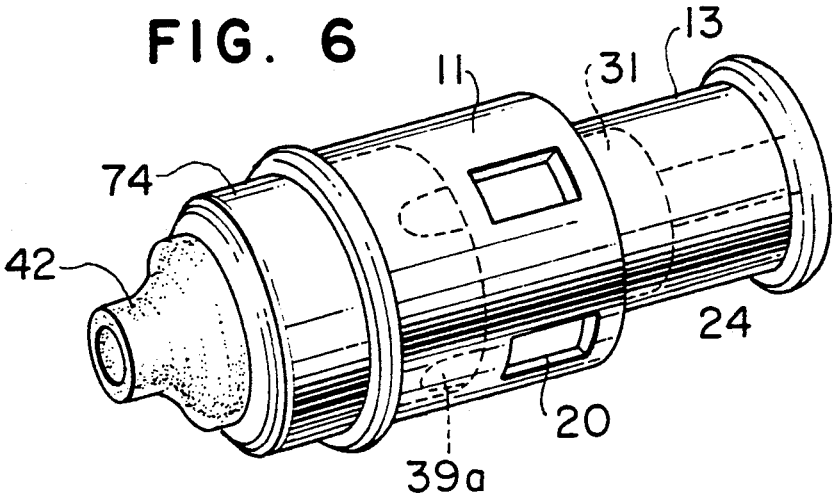
FIG. 6 is perspective view of the whole movable part of FIG. 4.
Figure 7:
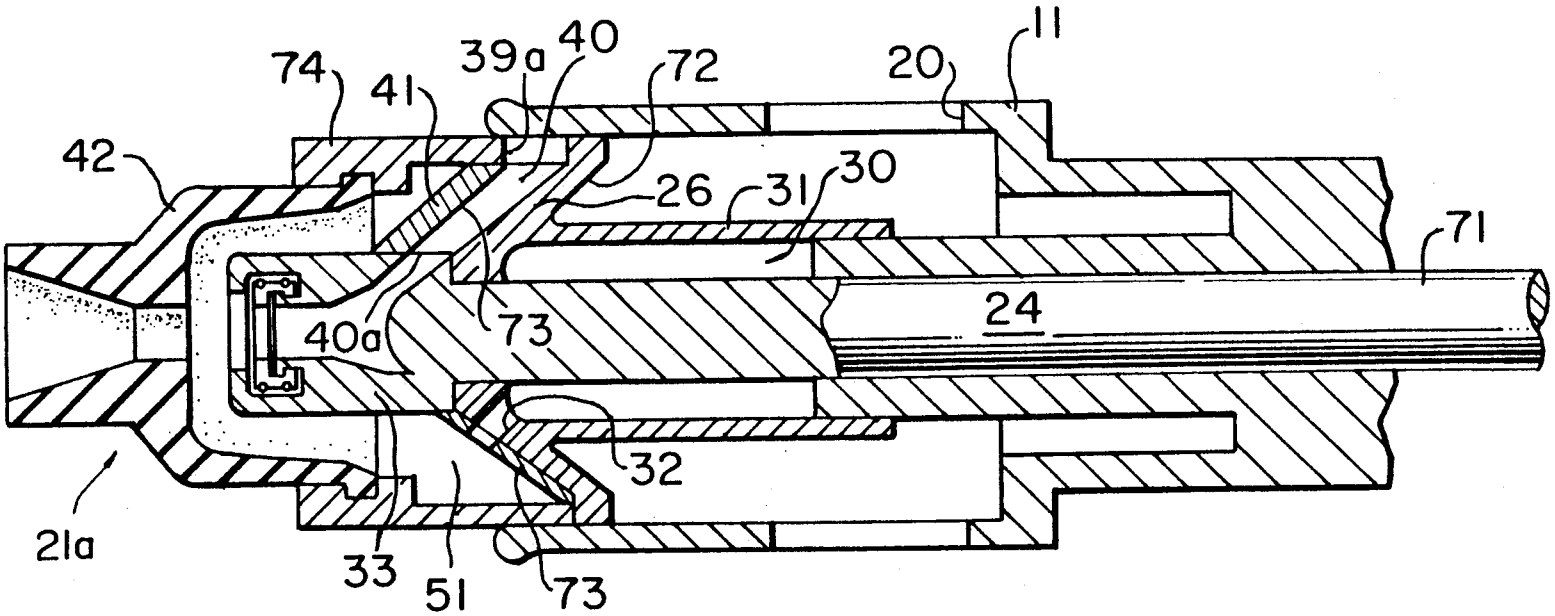
FIG. 7 is a sectional view of a gas circuit breaker according to another preferred embodiment of the present invention.

In FIGS. 1 to 3, reference numeral 1 denotes a closed container; an inside 2 is filled with an arc-extinguishing gas such as $SF_6$ gas. A shaft portion 5 of a fixed element body 4 made of an electrically conductive material is fixed at one end 6 thereof to an end wall 3 of the closed container 1. The fixed element body 4 is constituted by a central fixed element portion, that is, a fixed arc contactor portion 9 extending in an axial direction A from the center of a flange portion 8 formed at the other end 7 of the shaft portion 5, and a hollow cylindrical main fixed element portion 10 extending from the circumferential edge of the flange portion 8 in the axial direction A.

Reference numeral 11 denotes a frame body fixed to and allowed to stand stationary with respect to the closed container 1 which is like the fixed element body 4. The frame body 11 has a cylindrical base portion 13 of large thickness having a central hole 12. A hollow cylindrical puffer piston portion 15 is formed to extend from a radially inner edge portion of an end portion 14 of the base portion 13 in an axial direction B. The cylindrical piston portion 15 has a hole 16 which is coaxial with and has the same diameter as that of the central hole 12. A cylindrical portion 17 of medium diameter is formed to extend from a radially outer edge portion of the end portion 14 of the base portion 13 in the axial direction B; a flange portion 18 is formed to extend radially outwardly from the end of the medium-diameter cylindrical portion 17; and a cylindrical portion 19 of large diameter is formed to extend from the outer edge of the flange portion 18 in the axial direction B. Reference numeral 20 denotes a plurality of openings formed circumferentially equidistantly, in the large-diameter cylindrical portion 19 serving as block means, at the axially predetermined position C thereof.

Reference numeral 21 denotes a movable part made of an electrically conductive material which is movable in the axial directions A and B with respect to the fixed element body 4. The movable part 21 has an operating shaft portion 24 which is fixed at one end 23 thereof to an operating device or actuator 22 and extends from the end 23 in the axial direction B while slidably passing through the holes 12, 16 of the frame body 11. The shaft portion 24 is formed at the other end 25 thereof with a hollow conical portion 26 which extends radially outwardly from the end 25 in the direction B. The conical portion 26 is curved smoothly at a tip end 27 thereof for permitting gas to flow smoothly to be described later. An outer edge portion 28 of the conical portion 26 is bent radially outwardly and brought into gastight contact with an inner peripheral surface 29 of the large-diameter cylindrical portion 19 of the frame body 11 in the state of FIG. 1. A cylindrical portion 31 serving as a puffer cylinder is formed to extend from an intermediate portion of the inside surface of the conical portion 26 in the axial direction A and fitted around the cylindrical piston portion 15 of the frame body 11 so as to define a cylindrical puffer chamber 30 in cooperation with the outer peripheral surface of the shaft portion 24. The conical portion 26 is formed with a hole 32 which opens into the chamber 30 so that, when the movable part 21 is moved in the direction A with respect to the frame body 11, the compressed gas is enabled to flow out of the chamber 30 with the insertion of the piston portion 15 into the chamber 30 in the direction B.

Further, a hollow cylindrical movable contactor portion, that is, a movable arc contactor portion 33 is formed to extend from the end of the shaft portion 24 in the axial direction B. The cylindrical movable contactor portion 33 is fitted around the central fixed element portion 9 in the inoperative state, that is, in the closed state (FIG. 1), and, when the movable part 21 is moved in the direction A with respect to the fixed element body 4, electric contact between the both is released.

The movable contactor portion 33 is formed in the outer peripheral surface thereof with concave portions 34 at a position close to the tip end, and ring springs 35 are provided in the concave portions 34. A space 36 defined inside the movable contactor portion 33 is diverged conically at a part 37 thereof close to the curved end 27 of the shaft portion 24.

A cylindrical portion 38 of large diameter, the tip end of which serves as a main movable element, is formed to extend in the axial direction B from the outer edge portion 28 of the conical portion 26. The large-diameter cylindrical portion 38 of the movable part 21 is fitted gastightly in the large-diameter cylindrical portion 19 of the frame body 11. The large-diameter cylindrical portion 38 is formed with a plurality of openings 39 circumferentially equidistantly at the position thereof in the vicinity of the outer edge portion 28. A passage 40 extending radially outwardly from the conical chamber 37 in the movable contactor portion 33 is formed between each of the openings 39 and the conical chamber 37. These passages 40 are defined by the conical portion 26 and a plurality of internal wall portions 41 each extending obliquely, so that each passage 40 is inclined with respect to the radial direction so as to make smooth the flow of gas from the chamber 36. The passages 40 serve as exhaust passages, and the openings 39 serve as exhaust ports.

Reference numeral 42 denotes a nozzle made of an electrically insulating material. The nozzle 42 comprises a hollow cylindrical large-diameter portion 43, a nozzle main body portion 45 of small diameter having a nozzle hole 44, and an intermediate portion 46 for connecting the large-diameter portion 43 with the main body portion 45. The nozzle hole 44 is constituted by a cylindrical hole portion 47 as a throat portion into which the central fixed element portion 9 is fitted gastightly, and a conical hole portion 48 extending outwardly therefrom. One end 49 of the large-diameter portion 43 of the nozzle 42 is brought into gastight engagement with the inside groove formed in an expanded end portion 50 of the large-diameter cylindrical portion 38 of the movable part 21, so that the nozzle 42 cooperates with the large-diameter cylindrical portion 38, the internal wall portions 41, the conical portion 26 and the movable contactor portion 33 of the movable part 21 to define an expansion chamber 51 in which the gas heated and compressed by the arc is stored or accumulated.

In addition, the fixed element body 4 and the movable part 21 are arranged in series in an AC line of 50 to 60 Hz, for example, through terminals 52 and 53. In the inoperative (closed) state of a circuit breaker 60 of the above construction, an electric current flows between the terminals 52 and 53 through electrical connections between the central fixed element portion 9 and the movable contactor portion 33 which are in contact with each other and between the main fixed element portion 10 and the large-diameter cylindrical portion 38 of the movable part 21 which are in contact with each other as shown in FIG. 1.

In breaking the electrical connection between the terminals 52 and 53, the circuit breaker 60 is operated in the following manner.

First, upon receipt of an instruction (signal) to interrupt the current, the operating device 22 is actuated to cause the shaft portion 24 of the movable part 21 to move in the direction A with respect to the fixed element body 4 and the frame body 11. This movement first breaks the electrical connection between the main fixed element portion 10 and the large-diameter cylindrical portion 38 of the movable part 21, but the central fixed element portion 9 and the movable contactor portion 33 are kept in contact with each other. The movement of the movable part 21 in the direction A causes the cylindrical piston portion 15 of the frame body 11 to be moved relatively into the puffer chamber 30 in the direction B, so that the pressure of gas in the puffer chamber 30 and the expansion chamber 51 communicated therewith is increased.

Further movement of the shaft portion 24 in the direction A causes the central fixed element portion 9 to slip out of the movable contactor portion 33, thus starting parting of the movable contactor portion 33 from the central fixed element portion 9. As a result, the arc discharge 61 starts to take place between the central fixed element portion 9 and the movable contactor portion 33. During an initial stage of such breaking operation, the central fixed element portion 9 still closes the hole 47 of the nozzle 42 so that relative insertion of the cylindrical piston portion 15 of the frame body 11 into the puffer chamber 30 in the direction B causes the increase of the pressure of the gas not only in the puffer chamber 30 and the expansion chamber 52 but also in the chamber 36 defined inside the movable contactor portion 33 in communication with the expansion chamber 51 and the exhaust passages 40 the openings 39 of which are closed by the cylindrical portion 38 serving as the block means. In addition, the arc 61 produced between the central fixed element portion 9 and the movable contactor portion 33 causes the gas in the expansion chamber 51 and the chamber 36 inside the movable contactor portion 33 to be heated, resulting in the increase of the pressure of the gas in the expansion chamber 51 and the like.

In case that the electric current to be interrupted is relatively small, since the arc 61 heats the gas to a relatively low degree, the gas is not so much heated nor compressed by the arc 61 but the gas in the chambers 30, 51, 36 and 40 has been compressed to reach a certain level of pressure due to insertion of the piston 15 into the puffer chamber 30. In consequence, as shown in FIG. 2, when a further movement of the movable part 21 in the direction A causes the central fixed element portion 9 to slip out of the throat-like cylindrical hole 47 of the nozzle 42, the gaseous plasm of the arc discharge 61 is cooled by the gas flow 62 flowing out of the expansion chamber 51 through the throat-like hole portion 47, that is, by means of puffering of the gas flow 62, resulting in that the electric resistance in this gaseous region is increased to extinguish the arc discharge 61 at a timing close to the zero-cross point of an instantaneous magnitude of AC electric current where the arc 61 is made thin, thereby breaking the electrical connection between the central fixed element portion 9 and the movable contactor portion 33.

In the circuit breaker 60, since no exhaust passage is formed in the shaft 24 unlike the conventional circuit breakers, the shaft 24 can be formed relatively small in diameter. In addition, only a small amount of gas is required for puffering in regard to a small current, so that the diameter of the puffer chamber 30 formed around the shaft 24 of relatively small diameter can be made relatively small as well, resulting in that the cross-sectional area of the puffer chamber 30 is reduced and, therefore, the operating force exerted by the operating device 22 can be reduced.

On the other hand, in case that the electric current to be interrupted is large, the gas continues to be heated and compressed by the arc 61 until the central fixed element portion 9 slips out of the throat hole portion 47 of the nozzle 42 as shown in FIG. 2, and however, it is impossible to extinguish the arc 61 by cooling it using only puffering of the gas flow 62 passing through the throat hole portion 47 of the nozzle 42. However, when the movable part 21 is further moved in the direction A to bring the breaking operation in its intermediate stage as shown in FIG. 3, the central fixed element portion 9 is made to come out of the conical hole 48 of the nozzle 42 and the exhaust ports 39 of the exhaust passages 40 are moved to the position C so as to be perfectly communicated with the openings 20 of the large-diameter cylindrical portion 19 as the block means. In consequent, the gaseous plasma of the arc discharge 61 is cooled by two gas flows, that is, double flows including the gas flow 62 flowing through the throat-like hole portion 47 from the puffer chamber 30 and the expansion chamber 51 the pressure in which has been increased and the gas flow 63 flowing from the expansion chamber 51 through the chamber 36. the exhaust passages 40 and the openings 39, resulting in that the electric resistance in this arc region is increased to extinguish the arc 61 at a timing close to the zero-cross point of the instantaneous magnitude of AC electric current, thus breaking the electrical connection between the central fixed element portion 9 and the movable contactor portion 33. The time from receipt of breaking instruction to extinguishment of the arc 61 is substantially equal to the time during which the instantaneous AC current value becomes zero twice (about 1/50 to 1/60 sec., for example).

In the circuit breaker 60, since the exhaust passages 40 ar arranged to extend radially outwardly between the movable contactor portion 33 and the puffer chamber 30 unlike the conventional circuit breakers, the length of the exhaust passage 40 can be reduced independent of the length of the puffer chamber 30. In consequence, the flow resistance of the exhaust passage 40 to the gas flow 63 discharged through the exhaust passages 40 and the openings 39 can be reduced so that the gas flow 63 can be made large sufficiently at the timing shown in FIG. 3, thereby assuring more reliably the extinguishment of the arc 61 using the gas flow 63 in cooperation with the gas flow 62.

In FIGS. 1 to 3, the movable part 21 is illustrated as being a single body in practice except the insulating nozzle 42. However, the movable part 21 may be an assembly of parts suitable to manufacture and assemble. FIGS. 4 to 7 show an example of the movable part 21 constituted by an assembly 21*a*.

The movable part 21*a* comprises four electrically conductive members 71, 72, 73 and 74 and an insulating nozzle 42. The first member 71 mainly forms a shaft portion 24 and a movable contactor portion 33. The movable contactor portion 33 of the first member 71 is formed circumferentially equidistantly with a plurality of (3 or 4, for example) notched portions 40*a* which partially form exhaust passages 40. The second member 72 mainly forms an outer peripheral wall or puffer cylinder 31 of a puffer chamber 30 and a conical wall portion 26 which partially forms the exhaust passages 40 and expansion chambers 51. The wall portion 26 is formed, in parts thereof which define the expansion chambers 51, with holes circumferentially equidistantly which serves as passages 32 for communicating the puffer chamber 30 with the expansion chambers 51. The expansion chambers 51, the holes 32 and the exhaust passages 40 are equal in number to each other. Further, in a part of this example (FIG. 4 to 6), a radially outer end portion 28 of the conical wall portion 26 does not extend perpendicularly but obliquely to the axial. The third member 73 is constituted by an umbrella-shaped member which mainly serves to partially form the peripheral walls of the exhaust passages 40. Convex portions of the bevel member serve to constitute wall portions 41 of the exhaust passages 40, and concave portions thereof are closely put on the conical portion 26 of the second member 72 to constitute the wall portions of the expansion chambers 51. The convex portions constituting the wall portions 41 are formed at circumferential positions where they exactly coincide with the notched portions 40*a* of the first member 71. The fourth member 74 serves to support airtightly the insulating nozzle 42 by a portion of the inner peripheral wall of a cylindrical portion 38 serving as the main movable element as well as to mainly form the expansion chambers 51. The fourth member 74 is put on the conical portion 26 of the second member 72 so as to exactly cover the movable contactor portion 33 of the first member 71 and the third member 73. The fourth member 74 is formed with notched portions 39*a* which correspond to the exhaust ports 39 at circumferential positions corresponding to the exhaust passages 40.

Figure 8:
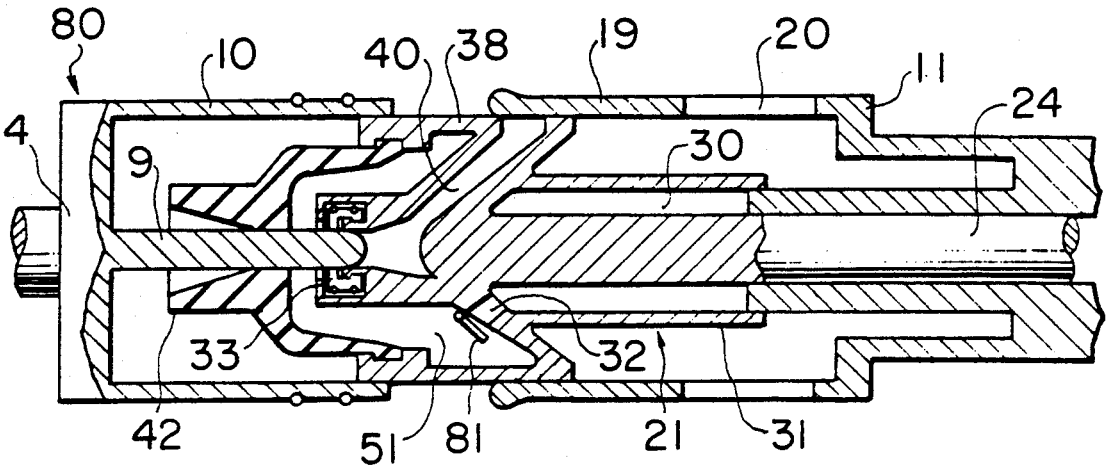
FIG. 8 is a sectional view of a gas circuit breaker according to still another preferred embodiment of the present invention.

FIG. 8 is a sectional view of a gas circuit breaker 80 according to another embodiment of the present invention (but the container 1 and the like are not shown). In FIG. 8, the same reference numerals are used to denote the same members and components as those of the embodiment shown in FIGS. 1 to 3.

In the gas circuit breaker 80 shown in FIG. 8, the passage 32 for communicating the puffer chamber 30 with the expansion chamber 51 is provided with a check valve 81. The check valve 81 is so designed as to permit the gas to flow from the puffer chamber 30 into the expansion chamber 51 but forbid the gas to flow from the expansion chamber 51 into the puffer chamber 30.

In consequence, in interrupting the electric current, when the gas pressure in the expansion chamber 51 is higher than that in the puffer chamber 30, since the check valve 81 is closed the compressed gas in the expansion camber 51 is first used for puffering against the arc 61. Namely, the compressed gas in the expansion chamber 51 serves as the source of cooling flows 62 and 63 along the arc 61. This puffering of the cooling flows 62 and 63 causes the gas pressure in the expansion chamber 51 to become lower than the gas pressure in the buffer chamber 30. Then the check valve 81 is opened to allow the gas-puffering cooling flows 62 and 63 to flow from the puffer chamber 30. Accordingly, the duration of gas puffering for extinguishment of the arc 61 can be made longer as compared with the gas circuit breaker 60 with no check valve 81, thereby assuring the extinguishment of the arc 61 more reliably. In addition, as the pressure in the puffer chamber 30 is not increase even when the pressure in the expansion chamber 51 is increased upon interrupting large electric current, the reaction force against operation of the shaft 24 can be made smaller.

Figure 9:
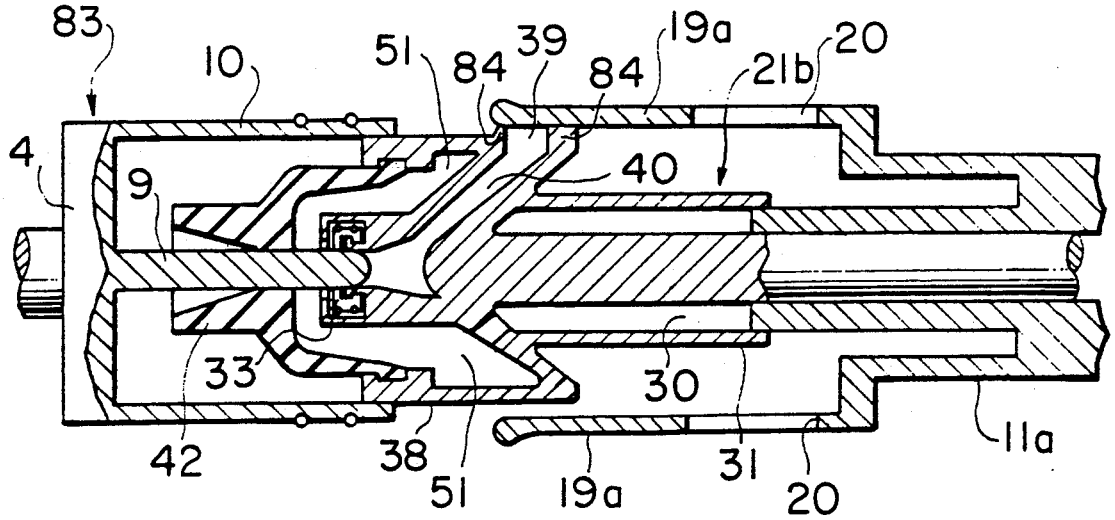
FIG. 9 is a sectional view of a gas circuit breaker according to still another preferred embodiment of the present invention.

FIG. 9 is a sectional view of a gas circuit breaker 83 according to still another embodiment of the present invention (but the container 1 and the like are not shown). In FIG. 9, the same reference numerals are used to denote the same members and components as those of the embodiment shown in FIGS. 1 to 3.

In the gas circuit breaker 83 shown in FIG. 9, a peripheral wall 84 of the exhaust port 39 of each of the exhaust passages 40 is formed by an annular projection which projects in the radial direction of the shaft 24. Namely, the annular projection 84 projecting in the radial direction of the shaft 24 is formed around each of the exhaust ports 39 in the large-diameter cylindrical portion 38 of a movable part 21*b* corresponding to the movable part 21 of FIG. 1. This makes the radius larger of a large-diameter cylindrical portion 19*a* of a frame body 11*a*, corresponding to the large-diameter portion 19 of the frame body 11 of FIG. 1, by an amount corresponding to the radial height of the projection 84. The large-diameter cylindrical portion 19*a*, therefore, is brought into sliding contact only with the projecting ends of the annular projections 84 formed circumferentially equidistantly on the movable part 21*b*, thus opening and closing the exhaust ports 39. As a result the slide contact area of the movable part 21*b* can be made smaller than that of the movable part 21, thereby making it possible to reduce the sliding resistance of the movable part 21*b*.

Figure 10:
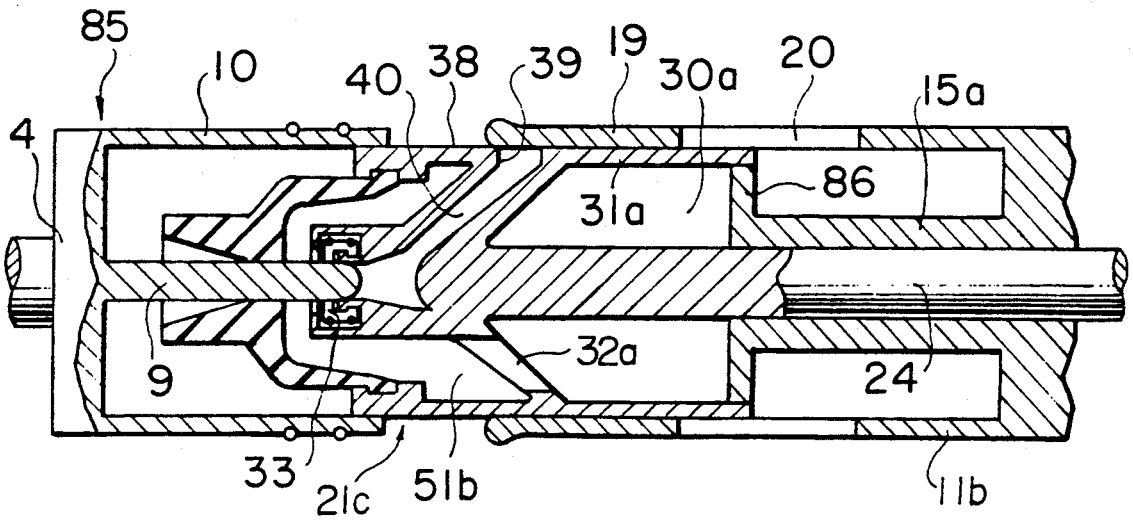
FIG. 10 is a sectional view of a gas circuit breaker according to still another preferred embodiment of the present invention.
Figure 11:
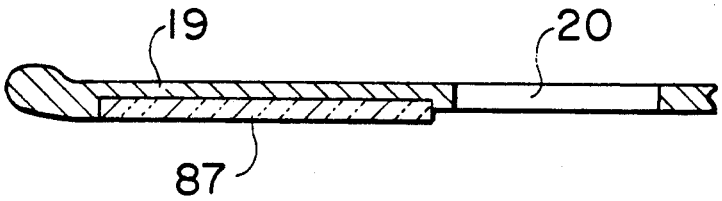
FIG. 11 is a sectional view of a part of a gas circuit breaker according to still another preferred embodiment of the present invention.
Figure 12:
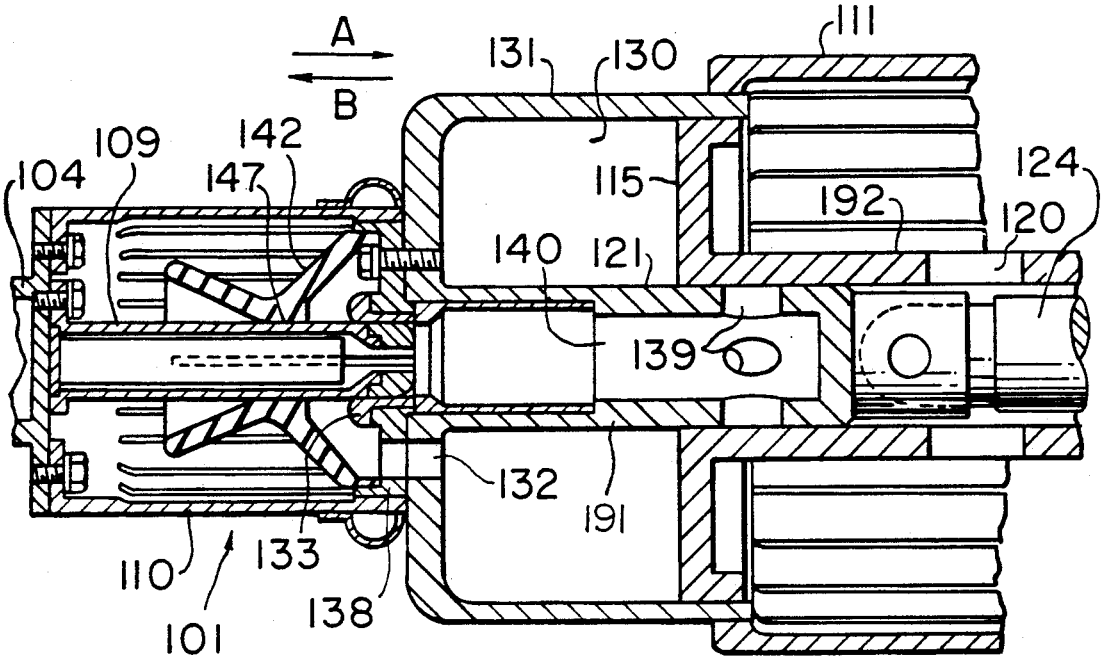
FIG. 12 (PRIOR ART)
FIG. 12 is a sectional view of a conventional puffer type gas circuit breaker.
Figure 13:
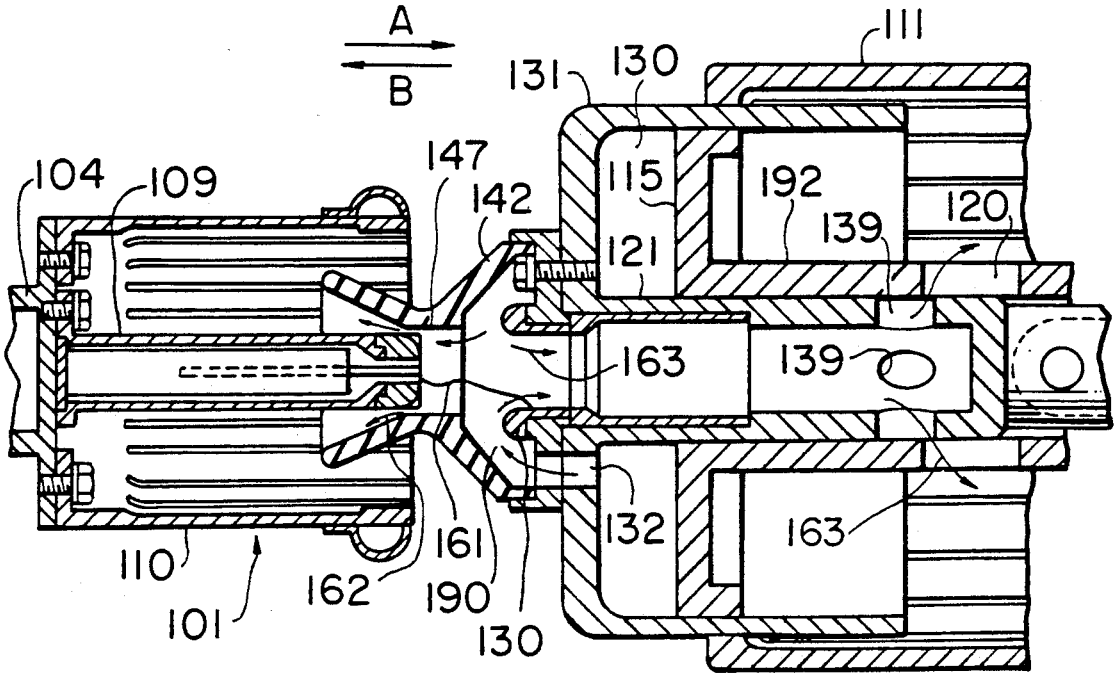
FIG. 13 (PRIOR ART)
FIG. 13 is a sectional view of the gas circuit breaker of FIG. 12, showing a state of operation.

FIG. 10 is a sectional view of a gas circuit breaker 85 according to still another embodiment of the present invention (but the container 1 and the like are not shown). In FIG. 10, the same reference numerals are used to denote the same members and components as those of the embodiment shown in FIGS. 1 to 3.

In the gas circuit breaker 85 shown in FIG. 10, a cylindrical portion 31*a* of a movable element 21*c*, corresponding to the cylindrical portion 31 of the movable part 21 of FIG. 1, has a large diameter so as to be brought into sliding contact with the large-diameter cylindrical portion 19 of the frame body 11. Therefore, a puffer chamber 30*a* has a large diameter as well, and a piston main body portion 86 of the frame body 11*b* which is inserted into the puffer chamber 30*a* is formed at the tip end of a hollow shaft piston portion 15*a*. In addition, a hole 32*a* formed in the conical wall 26 defining the end portion of the puffer chamber 30*a* has a large diameter as well. The structure of this embodiment is made more simple than the structures of the other embodiments mentioned above.

In each of the gas circuit breakers 60, 80, 83 and 85 of the above-described embodiments, the gas heated up to high temperature after making a contribution to arc-extinguishment is prevented from flowing out by the large-diameter cylindrical portion 19, 19*a* until the exhaust ports 39 of the exhaust passages 40 formed in the movable element 21, 21*a*, 21*b* or 21*c* coincide with the openings 20 formed in the large-diameter cylindrical portion 19 of the frame body 11. It is therefore preferable that the large-diameter cylindrical portion 19 is made of a heat-resisting and antifriction a lubricating material such as Teflon (polytetrafluroethylene), Teflon containing $A1_2O_3$ and the like which are freed from damage due to high temperature gas. In this case, the large-diameter cylindrical portion 19 may be wholly made of the above material or may be provided with a member 87 made of a heat-resisting and antifriction material only on the sliding surface thereof which is affected by the high temperature gas.

In addition, the main fixed element 10 can be dispensed with. In this case, the cylindrical portion of the movable member 21 does not function as the main movable element but functions as the wall for defining the expansion chamber.

What is claimed is:

1. A gas circuit breaker comprising a pair of contactors including a first contactor and a second contactor, said pair of contactors further including contact portions which are relatively separable from each other, said first contactor having therein a hollow exhaust passage having a first open end axially opened to a first region of a contact portion of said first contactor, an insulating nozzle of an electrically insulating material being stationary with respect to said first contactor and surrounding said contact portions of said pair of contactors so as to guide a flow of arc-extinguishing gas, and a puffer chamber means being stationary with respect to said first contactor for defining a puffer chamber therein cooperating with a buffer piston being stationary with respect to said second contactor and for compressing the arc-extinguishing gas in said puffer chamber in conjunction with a separating operation of said contact portions so as to supply the arc-extinguishing gas under guidance of said insulating nozzle, a portion of the arc-extinguishing gas from said puffer chamber means to a region of an arc being exhausted through said hollow exhaust passage of said first contactor, a portion of said hollow exhaust passage located near said first open end thereof and being located at a second region axially intermediate between said puffer chamber and said first contactor, said hollow exhaust passage extending substantially radially outwardly from said first region of said contact portion, and valve means being stationary with respect to said second contactor, for closing a second end of said hollow exhaust passage during an initial stage of the separating operation and for opening said second end of said hollow exhaust passage during a later stage of the separating operation.

2. A gas circuit breaker according to claim 1, said gas circuit breaker further comprises a hollow cylindrical member having therein a hollow portion communicating with an interior space of said insulating nozzle at a location between said puffer chamber and said first contactor, the interior space of said insulating nozzle and the hollow portion of said hollow cylindrical member defining an expansion chamber for compressing gas therein by said arc produced between said pair of contactors as said pair of contactors are separated from each other in breaking a current.

3. A gas circuit breaker according to claim 2, wherein said hollow exhaust passage extends substantially radially outwardly with respect to said hollow cylindrical member between said puffer chamber and said expansion chamber.

4. A gas circuit breaker according to claim 2, further comprising a check valve disposed between said puffer chamber and said expansion chamber for preventing the gas from flowing from said expansion chamber into said puffer chamber.

5. A gas circuit breaker according to claim 1, wherein said first open end of said exhaust passage is located such that said valve means is in sliding contact only with a portion of said first contactor forming said second end of said hollow exhaust passage so as to open and close said second end of said exhaust passage.

6. A gas circuit breaker according to claim 1, wherein a sliding portion of said valve means adjacent to said hollow exhaust passage includes a heat-resisting and antifriction material.

7. A gas circuit breaker according to claim 1, wherein a peripheral wall of said puffer chamber is a cylinder which is smaller in diameter than said valve means.

8. A gas circuit breaker according to claim 1, wherein a peripheral wall of said puffer chamber is a cylinder which is substantially equal in diameter to said valve means.

9. A gas circuit breaker according to claim 2, wherein said first contactor has therein a plurality of hollow exhaust passages which are disposed axially between said puffer chamber and said expansion chamber.

10. A gas circuit breaker according to claim 9, wherein each of said exhaust passages are disposed circumferentially equidistantly relative to other exhaust passages.

* * * * *